US006390841B1

(12) United States Patent
Zaguskin

(10) Patent No.: US 6,390,841 B1
(45) Date of Patent: May 21, 2002

(54) SELF-ALIGNING ELECTRICAL CONNECTOR

(75) Inventor: Alex Zaguskin, Farmington Hills, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 09/843,312

(22) Filed: Apr. 25, 2001

(51) Int. Cl.[7] ..... H01R 13/64
(52) U.S. Cl. ..... 439/248; 439/34
(58) Field of Search ..... 439/248, 247, 439/34

(56) References Cited

U.S. PATENT DOCUMENTS

| | | | | |
|---|---|---|---|---|
| 4,909,748 A | | 3/1990 | Kozono et al. | |
| 4,978,313 A | | 12/1990 | Kameyama et al. | |
| 5,197,896 A | | 3/1993 | Landis et al. | |
| 5,622,511 A | | 4/1997 | Jarrett | |
| 5,642,999 A | | 7/1997 | Kidd et al. | |
| 5,746,617 A | | 5/1998 | Porter, Jr. | |
| 5,759,047 A | * | 6/1998 | Brodsky et al. | 439/66 |
| 5,769,651 A | | 6/1998 | Omura et al. | |
| 5,876,228 A | | 3/1999 | Hayashi | |
| 5,893,768 A | | 4/1999 | Gawron et al. | |
| 6,017,233 A | | 1/2000 | Fry et al. | |
| 6,033,247 A | * | 3/2000 | Gregory, II | 439/248 |

* cited by examiner

*Primary Examiner*—Khiem Nguyen
*Assistant Examiner*—Hae Moon Hyeon
(74) *Attorney, Agent, or Firm*—Brooks & Kushman P.C.

(57) ABSTRACT

An electrical connector adapted to receive a mating connector member is provided. The electrical connector includes an elastomeric base and a connector member supported on the elastomeric base, where the connector member is operable to mate with the mating connector. The elastomeric base is configured to allow the connector member to be resiliently displaced along substantially orthogonal x, y, and z axes in order to facilitate alignment between the connector member and the mating connector during their assembly.

20 Claims, 4 Drawing Sheets

SELF-ALIGNING ELECTRICAL CONNECTOR

BACKGROUND OF THE INVENTION

1. Field of the Invention

This invention relates to a self-aligning electrical connector suitable for use in automotive vehicles.

2. Background Art

Automotive vehicle doors generally include three separate panels. An outer metallic, plastic, or fiberglass panel is joined to an inner metal panel to create a door frame, and an interior trim panel is mounted on the inner panel. The interior trim panel is constructed of rigid plastic or other materials and can be covered with a vinyl or cloth material to create a surface which faces the vehicle occupant. The trim panel mounts various electrical connections and controls including mirror controls, window switches, and door locks.

The switches, controls, and other electrical components mounted on the interior trim panel have attached lead wires which are joined to terminals in an electrical connector, the housing of which is attached to the trim panel. Likewise, an opposed electrical connector, mateable with the trim panel connector, accepts lead wires from the accessories and is typically attached to the inner vehicle panel. In order to communicate electrical signals from the controls to the accessories, the trim panel connector and inner panel connector must be mated by movement of at least one of the panels toward the other.

Often, an assembler must manually mate the connectors prior to the trim panel being mounted to the inner vehicle panel. Since the inner panel and the trim panel must be quite close in order to accomplish this task, the connectors are typically not visible to the assembler during the assembly process. This type of connection is referred to as a blind connection, which can involve considerable assembly time when a precise connection of the trim panel connector to the inner panel connector is required.

Several connectors have been developed which do not require precise alignment to be connected while assembling the door of a vehicle. More specifically, a connection system can include a fixed portion and an opposed "floating" portion which is movable in order to align and couple with the fixed portion. For example, U.S. Pat. No. 6,017,233 discloses a system for mounting an electrical connector to a panel, wherein the panel has a central aperture formed therein. A connector housing has a mating portion adapted to pass through the central aperture with substantial clearance, permitting floating motion relative to the panel. Likewise, U.S. Pat. No. 5,197,896 discloses an electrical connector which is mounted to float in a panel of a power supply module, wherein the panel includes a T-shaped cut-out to provide two-dimensional floating movement of the connector.

While such floating connectors such as those described above provide a start in addressing the need for reduced precision in connector alignment, these connectors are only capable of movement within the plane of the panel to which they are attached, and not along an axis generally perpendicular to the panel. Furthermore, due to the panel apertures required for floating movement, the connectors will have a gravity bias toward the downward end of the aperture, which increases the difficulty of mating the connectors. Still further, the mated connectors may be free to move within the door once assembled, which results in undesirable noise during vehicle use.

SUMMARY OF THE INVENTION

Therefore, it is an object according to the present invention to provide an electrical connector that is capable of resilient displacement along three substantially orthogonal axes in order to facilitate alignment with a mating connector.

It is a further object according to the present invention to provide an electrical connector that accomplishes self-alignment with a mating connector without susceptibility to gravitational forces.

It is another object according to the present invention to provide a self-aligning electrical connector that simplifies the assembly process and is suitable for blind mating applications.

Accordingly, an electrical connector is provided which is adapted to receive a mating connector. The electrical connector includes an elastomeric base and a connector member supported on the elastomeric base, where the connector member is operable to mate with the mating connector. The elastomeric base is configured to allow the connector member to be resiliently displaced along substantially orthogonal x, y, and z axes in order to facilitate alignment between the connector member and the mating connector during their assembly.

The elastomeric base includes a central portion disposed below and supporting the connector member. The central portion is capable of tolerating compressive and tensile forces to allow the base to be resiliently displaced alongat least the z axis. The central portion includes an undulating surface which preferably is only partially in contact with the first substrate. The central portion also includes a top surface having a lip sized to receive a bottom rim of the connector member and retain the connector member to the base.

The elastomeric base further includes a perimeter portion mounted to the first substrate, and an intermediate portion connecting the perimeter portion and the central portion. In a preferred embodiment, the intermediate portion includes at least one arm extending between the perimeter portion and central portion on each side of the connector member. In an alternative embodiment, the intermediate portion includes at least one rib extending around the connector member. The arms and the rib are each capable of tolerating compressive and tensile forces to allow the base to be resiliently displaced along at least the x and y axes.

Typically, the elastomeric base is mounted to a first substrate, such as an interior trim panel of an automotive vehicle. Likewise, the mating connector member is affixed to a second substrate, such as an inner vehicle panel, spaced from the first substrate. The first substrate can be provided with a recess into which the base is disposed and affixed. Alternatively, the base can be affixed to the first substrate by pins. Preferably, the base is constructed of a rubber material, and the connector member is constructed of a plastic material.

The above objects along with other objects, features, and advantages of the present invention are more readily understood from a review of the attached drawings and the accompanying specification and claims.

DETAILED DESCRIPTION OF THE PREFERRED EMBODIMENT(S)

The present invention is an electrical connector capable of movement along three substantially orthogonal axes in order to align with a mating connector. The electrical connector of the present invention can be used to electrically couple components in an electrical circuit assembly, and is especially useful for automotive applications, such as where an electrical connection must be established between controls mounted on an interior trim panel and corresponding accessories disposed within the vehicle door frame. Due to its design, the electrical connector can be resiliently displaced along the plane of the panel to which it is mounted, as well along an axis generally perpendicular to the plane of the panel. This capability greatly facilitates mating of the connectors, especially under circumstances where blind assembly is required.

Figure 1:
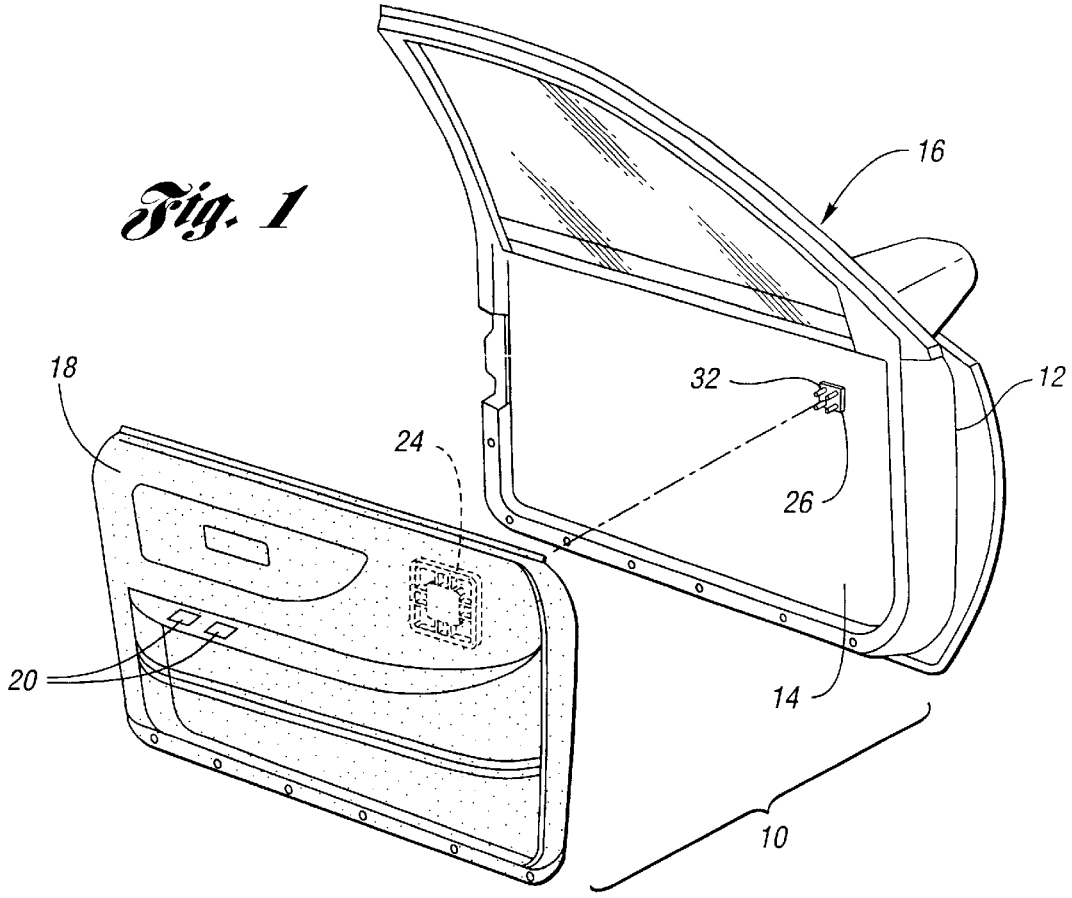
FIG. 1 is an exploded, perspective view of a vehicle door prior to assembly, wherein the electrical connector of the present invention is mounted on an interior trim panel and a mating connector is mounted on an inner vehicle panel.

Referring first to FIG. 1, a schematic, exploded view of a typical automobile door 10 is depicted. Door 10 includes an outer vehicle panel 12, which can be constructed from plastic, metal, or fiberglass, and a metallic inner vehicle panel 14 joined to the outer panel 12 in spaced relationship to define a door frame 16. An interior trim panel 18 is mounted on the inner vehicle panel 14, and is typically constructed of rigid plastic and covered with a vinyl or cloth material to create a finished surface for the vehicle occupant. The interior trim panel 18 mounts various electrical components and controls 20 including mirror controls, window switches, and door locks. The corresponding accessories, such as the mirror motor, the window motor, and the door latch are received in the door frame 16. For clarity, these mechanical accessories are not shown. The details of the electrical and mechanical components and associated circuitry are well known in the art.

The switches, controls, and other electrical components 20 mounted on the interior trim panel 18 have attached lead wires (not shown) which are joined to an electrical connector attached to an interior surface of the trim panel 18. The electrical connector 24 of the present invention is shown attached to the trim panel 18 in FIG. 1, wherein connector 24 is illustrated in greater detail in subsequent figures. An opposed electrical connector 26, mateable with connector 24 of the present invention, accepts lead wires (not shown) from the accessories mounted in the door frame 16 and is attached to the inner vehicle panel 14 facing the trim panel 18. In order to communicate electrical signals between the controls 20 and the accessories, the connectors 24 and 26 must be mated by movement of at least one of the panels 14, 18 toward the other.

As shown in FIG. 1, the directional reference system associated with the vehicle door 10 includes an x-axis extending across the width of the door 10, a y-axis extending across the height of the door 10, and a z-axis extending perpendicular to the door 10, across the width of the vehicle. During assembly of the door 10, an assembler moves the interior trim panel 18 toward the inner vehicle panel 14 generally along the z-axis, such that connector 26 attached to the inner panel 14 comes into contact with connector 24 mounted on the trim panel 18. Alignment of the connectors 24, 26 during assembly is facilitated by the capability of connector assembly 24 of the present invention to be resiliently displaced along each of the x, y, and z axes, as will be described below.

Figure 2:
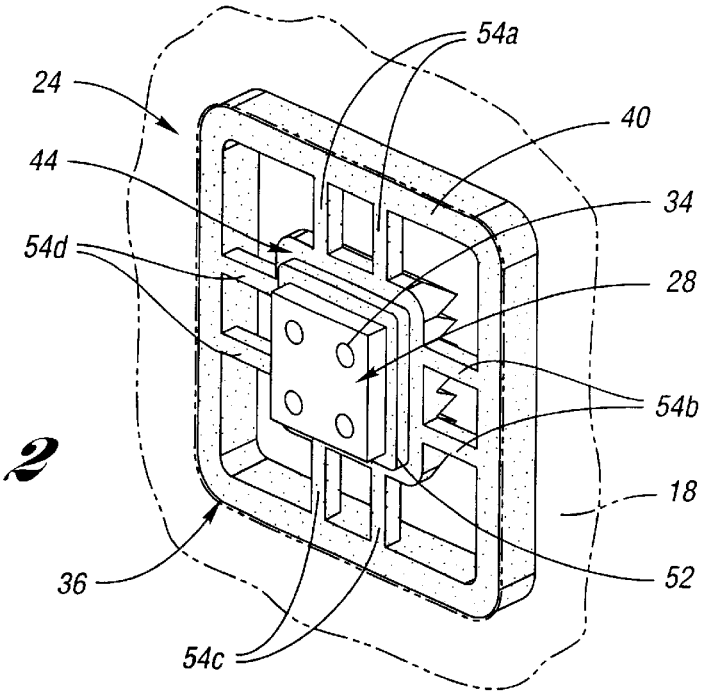
FIG. 2 is a perspective view of the electrical connector of the present invention.
Figure 3:
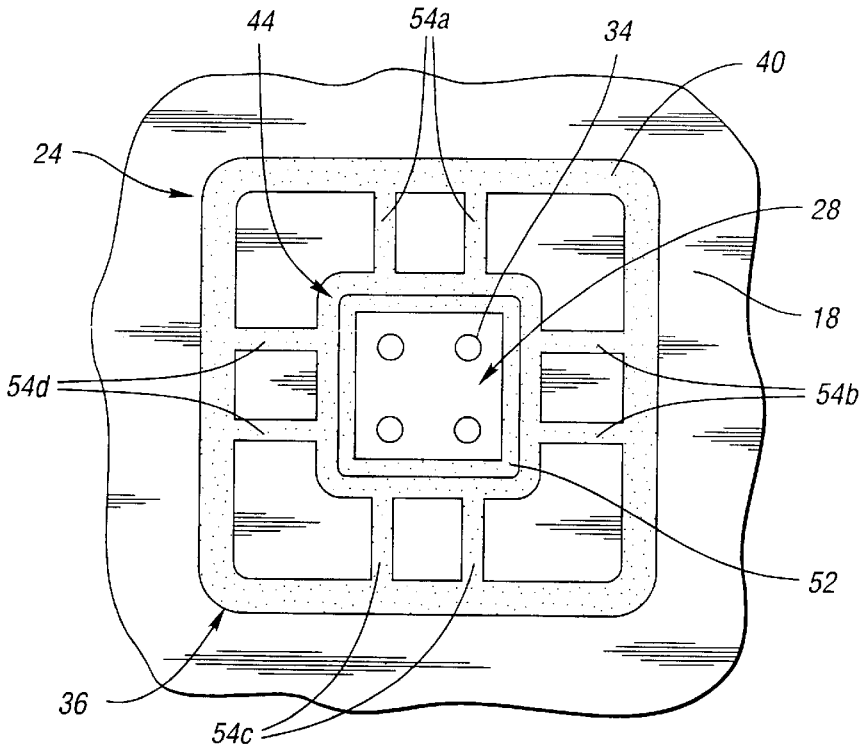
FIG. 3 is a top plan view of the electrical connector of FIG. 2 mounted in a substrate.
Figure 4:
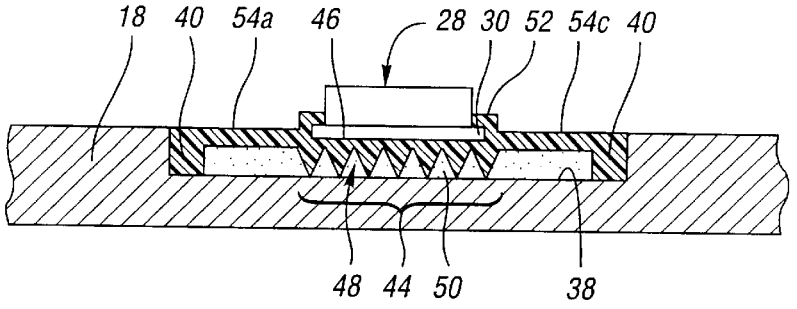
FIG. 4 is a cross-sectional view of the electrical connector of FIG. 2, wherein the connector is mounted in a recess provided in the substrate.

Referring now to FIGS. 2–4, connector assembly 24 includes a housing 28 which is preferably molded as a unitary structure from a suitable plastic material. Housing 28 is shown and described herein as being generally square, but could be of any shape appropriate for the intended application. Housing 28 preferably includes a bottom rim 30 extending outwardly therefrom which is used in mounting connector 24, as described below. Although not visible in the drawings, connector 24 has terminals therewithin to which lead wires from the trim panel controls 20 are joined. Likewise, connector 26 has terminals therewithin joined to lead wires extending from the accessories. As best shown in FIGS. 1 and 8, connector 26 includes pins 32 extending therefrom which are in electrical communication with the terminals of connector 26, and connector 24 includes chambers 34 formed therein which are in electrical communication with the terminals of connector 24. Pins 32 are sized to be received in corresponding chambers 34 in order to establish an electrical connection between connectors 24, 26. Of course, the location of pins 32 and chambers 34 could be reversed, such that pins 32 would be provided on connector 24 and chambers 34 would be provided on connector 26.

As shown in FIGS. 2–4, connector 24 of the present invention includes an elastomeric base 36 which supports connector housing 28 and is mounted to the trim panel 18. Base 36 is constructed using rubber or another suitable elastomeric material. Preferably, base 36 is formed from a heat resistant rubber material in order to allow connector assembly 24 to be useful in high-temperature environments. Base 36 can be of any size, shape, and thickness appropriate for the intended connector application, and trim panel 18 is preferably provided with a recess 38 sized to receive base 36 therein and support base 36 from the bottom and sides.

Figure 5:
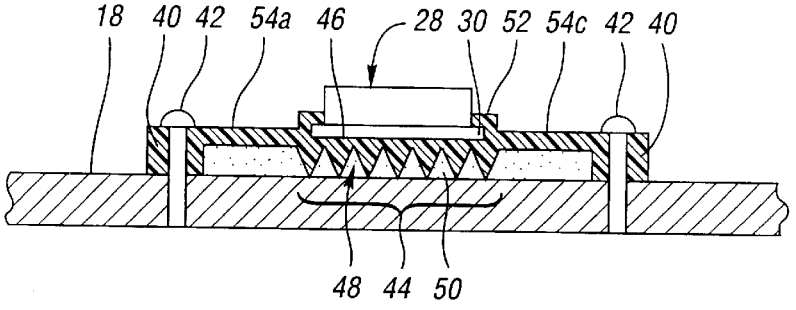
FIG. 5 is a cross-sectional view of the electrical connector of FIG. 2, wherein the connector is mounted to the substrate using pins.

Base 36 includes a perimeter portion 40 which is mounted to the trim panel 18. In a preferred embodiment, perimeter portion 40 is affixed within recess 38 with adhesive as shown in FIG. 4. In an alternative embodiment depicted in FIG. 5, mounting pins 42 are provided either molded integrally with trim panel 18 or affixed thereto to receive perimeter portion 40 and attach base 36 to trim panel 18. Base 36 further includes a central portion 44 disposed beneath and supporting connector 24. Central portion 44 is constructed to be capable of tolerating compressive and tensile forces to allow base 36 to be resiliently displaced at least along the z-axis. Central portion 44 includes a top surface 46 in contact with connector housing 28, and a bottom surface 48 at least partially in contact with the trim panel 18. In a preferred embodiment, top surface 46 is generally flat, and bottom surface 48 includes cutout areas 50 which do not contact trim panel 18. As such, bottom surface 48 is preferably of an undulating-type design, such as the sawtooth pattern shown or any other design capable of resilient displacement along the z-axis. Top surface 46 of central portion 44 includes a lip 52 sized to receive bottom rim 30 of connector housing 28 and retain connector housing 28 to base 36. Importantly, central portion 44 is not affixed to trim panel 18, such that central portion 44 is free to move along the x and y axes as well as the z-axis.

In a preferred embodiment, base 36 further includes an intermediate portion comprising at least one arm 54*a,* 54*b,* 54*c,* 54*d* extending between perimeter portion 40 and central portion 44 on each side of connector housing 28, as illustrated in FIG. 3. Arms 54*a,* 54*b,* 54*c,* 54*d* preferably have lesser thickness than perimeter portion 40 as shown, but could also have an undulating design similar to that of central portion 44. Arms 54*a,* 54*b,* 54*c,* 54*d* are capable of tolerating compressive and tensile forces to allow base 36 to be resiliently displaced in any direction along the plane of trim panel 18, i.e., the x and y axes.

Figure 6:
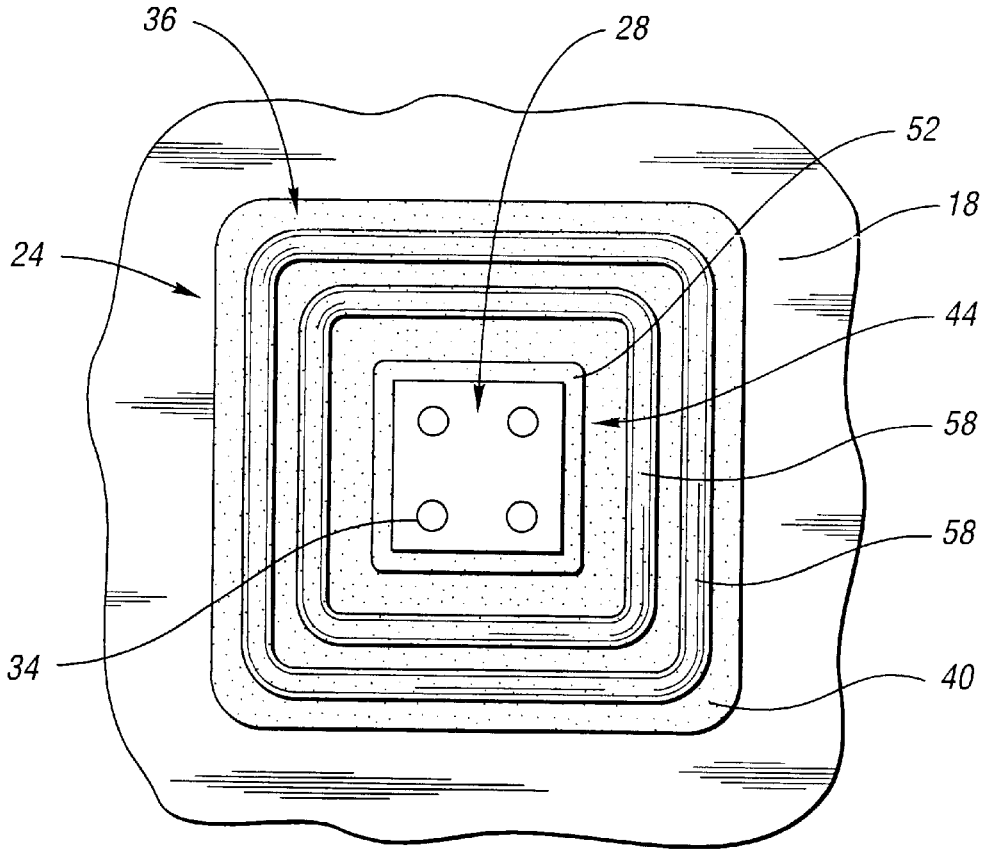
FIG. 6 is a top plan view of an alternative embodiment of the electrical connector of the present invention.
Figure 7:
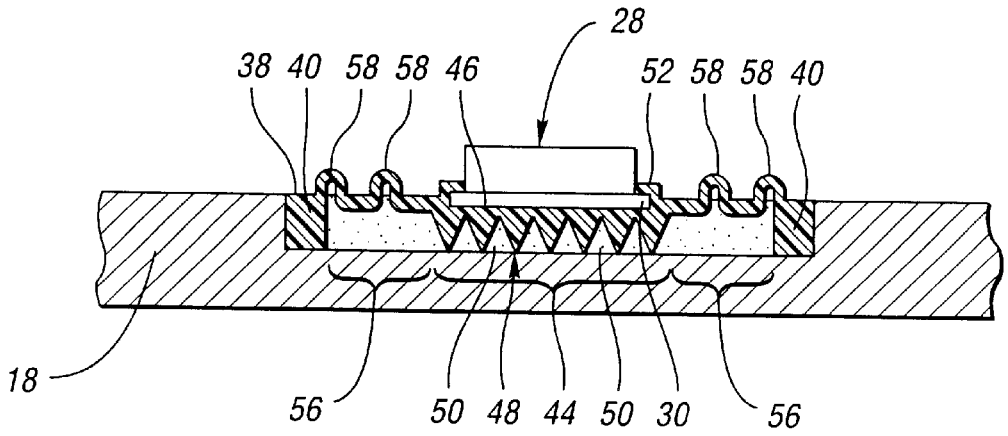
FIG. 7 is a cross-sectional view of the electrical connector of FIG. 6.

In an alternative embodiment depicted in FIGS. 6 and 7, base 36 includes an intermediate portion 56 spanning the area between perimeter portion 40 and central portion 44, wherein intermediate portion 56 has at least one rib 58 extending around connector housing 28. The one or more ribs 58 are designed to accommodate compressive and tensile forces, allowing base 36 to be resiliently displaced within the plane of the trim panel 18. Therefore, either design of base 36 enables connector 24 to be resiliently displaced a finite amount along x and y axes generally parallel to the plane of the trim panel 18 and along a z axis generally perpendicular to the plane of the trim panel 18 in order to facilitate alignment of connectors 24, 26 during assembly of the trim panel 18 to the inner vehicle panel 14. Furthermore, base 36 allows connector 24 to be securely held within trim panel 18, such that the position of connector 24 within trim panel 18 is not susceptible to the force of gravity.

Figures 8A, 8B, 8C:
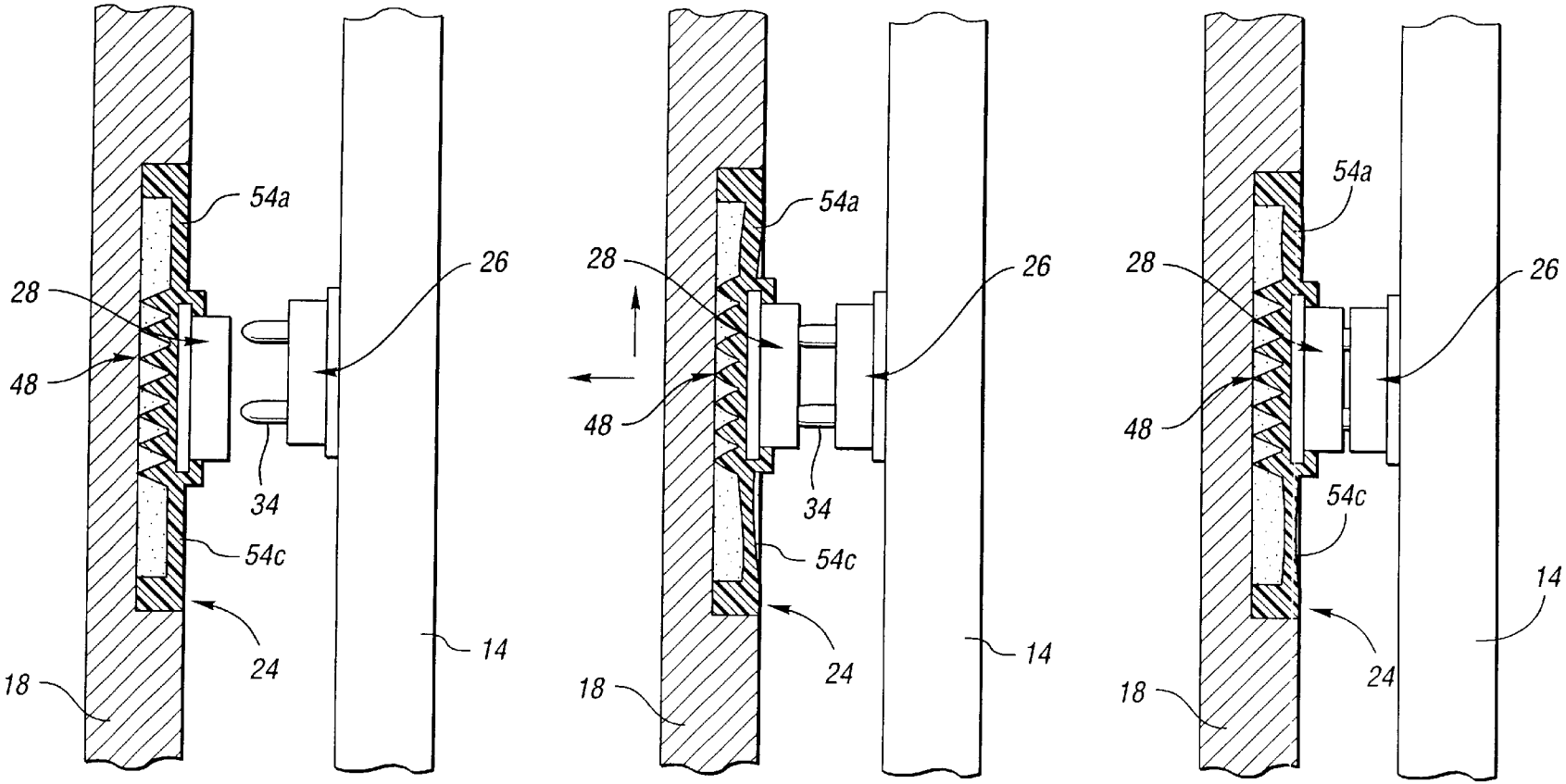
FIGS. 8*a*–8*c* are cross-sectional views of the electrical connector of FIG. 2 just prior to engagement, during initial engagement, and following mating, respectively, with an opposed connector.

Referring now to FIG. 8a, connector 24 of the present invention is shown mounted to a first substrate, such as interior trim panel 18. Also shown is opposed mating connector 26 prior to engagement with connector 24, wherein connector 26 is mounted to a second substrate, such as inner vehicle panel 14. In FIG. 8*b,* connector 26 is shown slightly misaligned with connector 24 along the yaxis during the initial engagement of pins 32 with connector housing 28. Therefore, connector 24 is displaced from its neutral position of FIG. 8*a* with respect to the trim panel 18 in order to accommodate the misalignment. With reference to FIG. 8*b,* top arms 54*a* compress while bottom arms 54*c* elongate within the plane of trim panel 18. In addition, central portion 44 compresses along a plane generally perpendicular to trim panel 18 (z axis) to absorb the force of pins 32 engaging connector housing 28. Once all external forces have subsided and connectors 24 and 26 are mated as shown in FIG. 8c, base 36 will regain its normal shape and thereby return connector 24 together with the mated connector 26, preferably in locked engagement, to the neutral position with respect to the trim panel 18. Of course, misalignment between connectors 24, 26 in other directions within the plane of the trim panel 18 can be similarly accommodated by connector assembly 24.

Therefore, connector assembly 24 of the present invention allows the trim panel 18 to be easily attached to the inner vehicle panel 14, and a good electrical connection achieved, even during blind assembly, due to self-alignment of connector assembly 24 along all three axes. Due to the displacement capability of base 36, the connectors 24, 26 are not subjected to large stresses or strains during assembly. As a result, failures due to connector damage are reduced and sufficient electrical contact between the connectors 24, 26 is promoted. Furthermore, during operational movement of the vehicle and even opening and closing of the door, the trim panel 18 may experience forces or shocks which could cause connectors 24, 26 to become separated. The design of base 36 allows connector 24 to be displaced without affecting the integrity of the connection with connector 26.

Although connector 24 of the present invention is shown and described herein as being attached to an interior trim panel 18, it is understood that connector 24 could alternatively be attached to inner vehicle panel 14 or another suitable substrate. In addition, connector 26 need not be mounted to any substrate for use with connector 24 of the present invention. Furthermore, it is understood that although connector 24 is shown and described herein with reference to use in an vehicle door, connector 24 may be used in any application where it is necessary to establish an electrical connection between components in an electrical circuit assembly.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An electrical connector adapted to receive a mating connector, the electrical connector comprising:

an elastomeric base mounted to a vehicle panel; and a connector member supported on the elastomeric base and operable to mate with the mating connector, wherein the elastomeric base is configured to allow the connector member to be resiliently displaced along substantially orthogonal x, y, and z axes in order to facilitate alignment between the connector member and the mating connector during assembly.

2. The electrical connector according to claim 1, wherein the elastomeric base includes a central portion disposed below the connector member and supporting the connector member, the central portion being capable of tolerating compressive and tensile forces to allow the base to be resiliently displaced along at least the z axis.

3. The electrical connector according to claim 2, wherein the central portion includes an undulating bottom surface.

4. The electrical connector according to claim 2, wherein the central portion includes a top surface having a lip sized to receive a bottom rim of the connector member and retain the connector member to the base.

5. The electrical connector according to claim 2, wherein the elastomeric base includes a perimeter portion mounted to the first vehicle panel.

6. The electrical connector according to claim 5, wherein the elastomeric base includes an intermediate portion connecting the perimeter portion and the central portion, the intermediate portion including at least one arm extending between the perimeter portion and the central portion on each side of the connector member, wherein the arms are capable of tolerating compressive and tensile forces to allow the base to be resiliently displaced along at least the x and y axes.

7. The electrical connector according to claim 5, wherein the elastomeric base includes an intermediate portion connecting the perimeter portion and the central portion, the intermediate portion including at least one rib extending around the connector member, wherein the at least one rib is capable of tolerating compressive and tensile forces to allow the base to be resiliently displaced along at least the x and y axes.

8. The electrical connector according to claim 1, wherein the base and the connector member are integrally formed.

9. The electrical connector according to claim 1, wherein the base is constructed of a rubber material.

10. The electrical connector according to claim 1, wherein the connector member is constructed of a plastic material.

11. An electrical connector assembly adapted to receive a mating connector member, the assembly comprising:

a first vehicle panel;

an elastomeric base mounted to the first vehicle panel, the base having a perimeter portion affixed to the first vehicle panel, a central portion constructed for resilient displacement along at least a z axis generally perpendicular to the first vehicle panel, and an intermediate portion connecting the perimeter portion and the central portion and constructed for resilient displacement along at least x and y axes which are substantially orthogonal to each other and generally parallel to the first vehicle panel; and a connector member supported on the central portion of the elastomeric base, the connector member being operable to mate with the mating connector member, wherein alignment between the connector member and the mating connector member during assembly is facilitated by movement of the base along at least one of the x, y, and z axes.

12. The assembly according to claim 11, wherein the first vehicle panel includes a recess into which the base is disposed.

13. The assembly according to claim 11, wherein the base is mounted to the first vehicle panel by pins.

14. The assembly according to claim 11, wherein the first vehicle panel includes an interior trim panel of an automotive vehicle.

15. The assembly according to claim 11, wherein the mating connector member is mounted to a second vehicle panel spaced from the first vehicle panel.

16. The assembly according to claim 15, wherein the second vehicle panel includes an inner vehicle panel of an automotive vehicle.

17. The assembly according to claim 11, wherein the central portion of the base includes an undulating bottom surface only partially in contact with the first vehicle panel.

18. The assembly according to claim 11, wherein the intermediate portion includes at least one arm extending between the perimeter portion and central portion on each side of the connector member, wherein the arms capable of tolerating compressive and tensile forces to allow the base to be resiliently displaced along at least the x and y axes.

19. The assembly according to claim 11, wherein the intermediate portion includes at least one compressible rib extending around the connector member, wherein the at least one rib is capable of tolerating compressive and tensile forces to allow the base to be resiliently displaced along at least the x and y axes.

20. An automotive interior trim panel and electrical connector assembly adapted to receive a mating connector member mounted on an inner vehicle panel, the assembly comprising:

an interior trim panel;

an elastomeric base mounted on the interior trim panel, the base having a perimeter portion affixed to the trim panel, a central portion at least partially in contact with the trim panel and constructed for resilient displacement along at least a z axis generally perpendicular to the trim panel, and an intermediate portion connecting the perimeter portion and the central portion, the intermediate portion including at least one arm extending between the perimeter portion and the central portion on each side of the connector member, wherein the arms are capable of tolerating compressive and tensile forces to allow the base to be resiliently displaced along at least x and y axes which are substantially orthogonal to each other and generally parallel to the trim panel; and a connector member supported on the central portion of the elastomeric base, wherein alignment between the connector member and the mating connector member is facilitated by movement of the base along at least one of the x, y, and z axes during assembly of the interior trim panel and the inner vehicle panel.

* * * * *